US005290473A

United States Patent [19]

Basu et al.

[11] Patent Number: 5,290,473

[45] Date of Patent: Mar. 1, 1994

[54] AZEOTROPE-LIKE COMPOSITONS OF 1,1,1,3,3,5,5,5-OCTAFLUOROPENTANE, C1-C5 ALKANOL AND OPTIONALLY NITROMETHANE

[75] Inventors: Rajat S. Basu; Ellen L. Swan, both of Erie, N.Y.

[73] Assignee: AlliedSignal Inc., Morris Township, Morris County, N.J.

[21] Appl. No.: 31,768

[22] Filed: Mar. 15, 1993

[51] Int. Cl.[5] ..... C11D 7/30; C11D 7/50; C23G 5/028

[52] U.S. Cl. ..... 252/171; 8/142; 134/12; 134/31; 134/38; 134/40; 134/42; 252/153; 252/162; 252/170; 252/364; 252/DIG. 9

[58] Field of Search ..... 252/153, 162, 170, 171, 252/364, DIG. 9; 134/38, 40, 42, 12, 31; 8/142

[56] References Cited

U.S. PATENT DOCUMENTS

| | | | |
|---|---|---|---|
| 3,927,129 | 12/1975 | Aaszeldine et al. | 260/653.1 R |
| 5,064,559 | 11/1991 | Merchant et al. | 252/171 |
| 5,100,572 | 3/1992 | Merchant | 252/171 |
| 5,171,902 | 12/1992 | Krespan et al. | 570/175 |
| 5,219,488 | 6/1993 | Basu et al. | 252/171 |
| 5,219,489 | 6/1993 | Swan et al. | 252/171 |

FOREIGN PATENT DOCUMENTS

| | | | |
|---|---|---|---|
| 0431458 | 6/1991 | European Pat. Off. . | |
| 3-252500 | 11/1991 | Japan | 252/171 |
| 4-346946 | 12/1992 | Japan . | |

OTHER PUBLICATIONS

F. A. Bloshchitsa et al., "Reaction of Hydroxy-and Carbonyl Compounds with Sulfur Tetrafluoride, XIV. Reaction of Aliphatic Oxocarboxylic Acids with $SF_4$", Zh. Org. Khim. vol. 21, No. 7, pp. 1414–1420 (1985).

*Primary Examiner*—Linda Skaling
*Attorney, Agent, or Firm*—Colleen D. Szuch; Jay P. Friedenson

[57] ABSTRACT

Stable azeotrope-like compositions of 1,1,1,3,3,5,5,5-octafluoropentane, $C_1$–$C_5$ alkanol and optionally nitromethane have been discovered which are useful as degreasing agents and as solvents in a variety of industrial cleaning applications including cold cleaning and defluxing of printed circuit boards and dry cleaning.

25 Claims, No Drawings

AZEOTROPE-LIKE COMPOSITONS OF 1,1,1,3,3,5,5,5-OCTAFLUOROPENTANE, C1-C5 ALKANOL AND OPTIONALLY NITROMETHANE

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Cold cleaning is another application where a number of solvents are used. In most cold cleaning applications, the soiled part is either immersed in the fluid or wiped with cloths or similar objects soaked in solvents and allowed to air dry.

Azeotropic or azeotrope-like compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is azeotrope-like, fractionation will occur and undesirable solvent distribution may act to upset the cleaning and safety of processing. Preferential evaporation of the more volatile components of the solvent mixtures, which would be the case if they were not azeotrope-like, would result in mixtures with changed compositions which may have less desirable properties, such as lower solvency towards soils, less inertness towards metal, plastic or elastomer components, and increased flammability and toxicity.

Fluorocarbon solvents, such as trichlorotrifluoroethane (CFC-113), have attained widespread use in recent years as effective, nontoxic, and nonflammable agents useful in degreasing applications and other solvent cleaning applications. The art has looked towards azeotrope or azeotrope-like compositions including the desired fluorocarbon components such as CFC-113 and which also include components which contribute additionally desired characteristics, such as polar functionality, increased solvency power, and stabilizers. The art is continually seeking new fluorocarbon based azeotrope-like mixtures which offer alternatives for new and special applications for vapor degreasing and other cleaning applications. Currently, fluorocarbon based azeotrope-like mixtures with minimal or no chlorine are of particular interest because they are considered to be stratospherically safer substitutes for presently used chlorofluorocarbons (CFCs). The latter are suspected of causing environmental problems in connection with the earth's protective ozone layer. Mathematical models have substantiated that hydrofluorocarbons, such as 1,1,1,3,3,5,5,5-octafluoropentane (HFC-458mfcf), will not adversely affect atmospheric chemistry since they do not contribute to ozone depletion and contribute only negligibly to global warming in comparison to chlorofluorocarbons such as CFC-113.

DESCRIPTION OF THE INVENTION

Our solution to the need in the art for substitutes for chlorofluorocarbon solvents is mixtures comprising 1,1,1,3,3,5,5-octafluoropentane (HFC-458mfcf), $C_1$–$C_5$ alkanol and optionally nitromethane.

For purposes of this invention, $C_1$–$C_5$ alkanol shall mean methanol, ethanol, isopropanol, n-propanol, t-butanol, isobutanol, n-butanol and t-amyl alcohol. N-propanol, n-butanol, t-amyl alcohol, isobutanol and t-butanol are preferred.

The present azeotrope-like compositions are advantageous for the following reasons. The HFC-458mfcf component does not deplete ozone and has reasonable solvency characteristics. The alkanol components also have good solvent properties dissolving polar contaminants. Nitromethane adds to the hydrolytic stability of the azeotropic blends in the presence of metals. Thus, when these components are combined in effective amounts, a stable, efficient azeotrope-like solvent results.

The preferred, more preferred and most preferred embodiments for each azeotrope-like composition of the invention are set forth in Table I below. The numerical ranges are understood to be prefaced by "about".

TABLE 1

| COMPONENTS | PREFERRED RANGE (WT. %) | MORE PREFERRED RANGE (WT. %) | MOST PREFERRED RANGE (WT. %) | BOILING POINT (°C.) (760 mm Hg) |
|---|---|---|---|---|
| HFC-458mfcf | 88–57 | 85–59.5 | 82–64.7 | 62.0 ± 1.0 |
| Methanol | 12–42 | 15–40 | 18–35 | |
| Nitromethane | 0–1.0 | 0–0.5 | 0–0.3 | |
| HFC-458mfcf | 90–59 | 88–64.5 | 86–69.7 | 64.0 ± 1.0 |
| Ethanol | 10–40 | 12–35 | 14–30 | |
| Nitromethane | 0–1.0 | 0–0.5 | 0–0.3 | |
| HFC-458mfcf | 92–69 | 90–72.5 | 88–74.7 | 66.0 ± 1.0 |
| Isopropanol | 8–30 | 10–27 | 12–25 | |
| Nitromethane | 0–1.0 | 0–0.5 | 0–0.3 | |
| HFC-458mfcf | 99–84 | 98–89.5 | 97–91.7 | 69.0 ± 1.0 |
| n-propanol | 1–15 | 2–10 | 3–8 | |

TABLE 1-continued

| COMPONENTS | PREFERRED RANGE (WT. %) | MORE PREFERRED RANGE (WT. %) | MOST PREFERRED RANGE (WT. %) | BOILING POINT (°C.) (760 mm Hg) |
|---|---|---|---|---|
| Nitromethane | 0–1.0 | 0–0.5 | 0–0.3 | |
| HFC-458mfcf | 99–89 | 99–91.5 | 98–92.7 | 70.0 ± 1.0 |
| n-butanol | 1–10 | 1–8 | 2–6 | |
| Nitromethane | 0–1.0 | 0–0.5 | 0–0.3 | |
| HFC-458mfcf | 90–71 | 88–74.5 | 87–78.7 | 70.0 ± 1.0 |
| isobutanol | 10–28 | 12–25 | 13–21 | |
| Nitromethane | 0–1.0 | 0–0.5 | 0–0.3 | |
| HFC-458mfcf | 91–71 | 90–74.5 | 88–77.7 | 68.0 ± 1.0 |
| t-butanol | 9–28 | 10–25 | 12–22 | |
| Nitromethane | 0–1.0 | 0–0.5 | 0–0.3 | |
| HFC-458mfcf | 99–89 | 99–91.5 | 98–93.7 | 71.0 ± 1.0 |
| t-amyl alcohol | 1–10 | 1–8 | 2–6 | |
| Nitromethane | 0–1 | 0–0.5 | 0–0.3 | |

All compositions within the indicated ranges, as well as certain compositions outside the indicated ranges, are azeotrope-like, as defined more particularly below.

The precise azeotrope compositions have not been determined but have been ascertained to be within the above ranges. Regardless of where the true azeotropes lie, all compositions within the indicated ranges, as well as certain compositions outside the indicated ranges, are azeotrope-like, as defined more particularly below.

We have determined that some of the preferred azeotrope-like compositions containing n-propanol, n-butanol, isobutanol, t-butanol or t-amyl alcohol are on the whole nonflammable liquids, i.e. exhibit no flash point when tested by the Tag Open Cup test method—ASTM D 1310-86 and Tag Closed Cup Test Method—ASTM D 56-82. This is advantageous because these mixtures will not require explosion proof equipment in the degreasers in which they are used. The flammable azeotrope-like compositions of the invention may be used in cold cleaning or specialty cleaning applications where flammability is not a concern.

The term "azeotrope-like composition" as used herein is intended to means that the composition behaves like an azeotrope, i.e. has constant-boiling characteristics or a tendency not to fractionate upon boiling or evaporation. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is contrasted with non-azeotrope-like compositions in which the liquid composition changes substantially during boiling or evaporation.

As is readily understood by persons skilled in the art, the boiling point of the azeotrope-like composition will vary with the pressure.

The azeotrope-like compositions of the invention are useful as solvents in a variety of vapor degreasing, cold cleaning and solvent cleaning applications including defluxing and dry cleaning.

In the process embodiment of the invention, the azeotrope-like compositions of the invention may be used to clean solid surfaces by treating said surfaces with said compositions in any manner well known to the art such as by dipping or spraying or use of conventional degreasing apparatus. Preferably, the azeotrope-like compositions of the invention are used to dissolve contaminants or remove contaminants from the surface of a substrate by treating the surface with the compositions in any manner well known to the art such as by dipping or spraying or use of conventional degreasing apparatus wherein the contaminants are substantially dissolved or removed.

HFC-458mfcf is not commercially available. It may be prepared by following the synthesis disclosed in F. A. Bloshchitsa, A. I. Burmakov, B. V. Kunshenko, L. A. Alekseeva and L. M. Yugopolski, *Reaction of hydroxy-and carbonyl compounds with sulfur tetrafluoride. XIV. Reaction of aliphatic oxocarboxylic acids with $SF_4$*, Zh. Org. Khim., Vol 21, no 7, 1985, pp. 1414–20 (English translation can be found in Russian Journal of Organic Chemistry, vol 21, no 7, 1985, pp. 1286–1291). The alcohol components and nitromethane are known materials and are commercially available.

EXAMPLES 1-5

The range over which the following compositions exhibit constant boiling behavior was determined using ebulliometry.

a) HCFC-458mfcf/methanol;
b) HFC458mfcf/ethanol;
c) HFC-458mfcf/isopropanol;
d) HFC-458mfcf/n-propanol; and
e) HFC-458mfcf/t-butanol The ebulliometer consisted of a heated sump. The upper part of the ebulliometer connected to the sump was cooled thereby acting as a condenser for the boiling vapors, allowing the system to operate at total reflux. Measured quantities of HFC-458mfcf were charged into the ebulliometer and brought to a boil. Then, measured amounts of a specific $C_1$–$C_5$ alcohol were titrated into the ebulliometer. The change in boiling point was measured with a platinum resistance thermometer. In the case of HFC-458mfcf/methanol, methanol was charged to the ebulliometer first and then HFC-458mfcf was added.

The results indicate that the following compositions are axeotropic or constant boiling at the stated temperatures at 760 mm Hg:

a) about 88–57/12–42 weight percent HFC-458mfcf/methanol at about 62° C.;
b) about 90–59/10–40 weight percent HFC-458mfcf/ethanol at about 64° C.;
c) about 92–69/8–30 weight percent HFC-458mfcf/isopropanol at about 66° C.;
d) about 99–84/1–15 weight percent HFC-458mfcf/n-propanol at about 69° C.; and
e) about 91–71/9–28 weight percent HFC-458mfcf/t-butanol at about 68° C.

EXAMPLES 6–16

The experiment outlined in Examples 1–5 above is repeated for the following compositions. Note that for binary mixtures, HFC-458mfcf is charged to the ebulliometer first followed by the alkanol. In the case of ternaries, HFC-458mfcf and the alkanol are changed to the ebulliometer first followed by nitromethane.

a) HFC-458mfcf/methanol/nitromethane;
b) HFC-458mfcf/ethanol/nitromethane;
c) HFC-458mfcf/isopropanol/nitromethane;
d) HFC-458mfcf/n-propanol/nitromethane;
e) HFC-458mfcf/n-butanol;
f) HFC-458mfcf/n-butanol/nitromethane;
g) HFC-458mfcf/isobutanol;
h) HFC-458mfcf/isobutanol/nitromethane;
i) HFC-458mfcf/t-butanol/nitromethane;
j) HFC-458mfcf/t-amyl alcohol; and
k) HFC-458mfcf/t-amyl alcohol/nitromethane.

The results indicate that the following compositions are azeotrope-like at 760 mm Hg at the stated temperatures.

a) about 88–57/12–42/1 weight percent HFC-458mfcf/methanol/nitromethane at about 62° C.;
b) about 90–59/10–40/1 weight percent HFC-458mfcf/ethanol/nitromethane at about 64° C.;
c) about 92–69/8–30/1 weight percent HFC-458mfcf/isopropanol/nitromethane at about 66° C.;
d) about 99–84/1–15/1 weight percent HFC-458mfcf/n-propanol/nitromethane at about 69° C.;
e) about 99–89/1–10 weight percent HFC-458mfcf/n-butanol at about 70° C.;
f) about 99–89/1–10/1 weight percent HFC-458mfcf/n-butanol/nitromethane at about 70° C.;
g) about 90–71/10–28 weight percent HFC-458mfcf/isobutanol at about 70° C.;
h) about 90–71/10–28/1 weight percent HFC-458mfcf/isobutanol/nitromethane at about 70° C.;
i) about 91–71/9–28/1 weight percent HFC-458mfcf/t-butanol/nitromethane at about 68° C.;
j) about 99–89/1–10 weight percent HFC-458mfcf/t-amyl alcohol at about 71° C.; and
k) about 99–89/1–10/1 weight percent HFC-458mfcf/t-amyl alcohol/nitromethane at about 71° C.

EXAMPLE 17

Performance studies were conducted wherein metal coupons were cleaned using a blend of HFC-458mfcf and n-propanol containing 5% by weight n-propanol. The metal coupons were soiled with various types of oils and heated to 93° C. so as to partially simulate the temperature attained while machining and grinding in the presence of these oils.

A small test tube with condensing coils near its lips was used. The HFC-458 mfcf/n-propanol composition was boiled in the test tube and condensed on the coils providing a vapor. The condensed solvent then dripped back into the test tube.

The metal coupons were held in the solvent vapor and then vapor rinsed for a period of 15 seconds to 2 minutes depending upon the oils selected. Cleanliness (i.e. total residual materials left after cleaning) of the coupons was determined by measuring the weight change of the coupons using an analytical balance. The results indicate that compositions of HFC-458mfcf/n-propanol are effective solvents, removing substantially all of the soil from the coupons.

EXAMPLES 18 THROUGH 32

The experiment outlined in Example 17 above is repeated using the compositions of Examples 1–16 as solvents. The results indicate that the compositions of Examples 1–16 are effective solvents, removing substantially all of the soil from the coupons.

EXAMPLES 33 THROUGH 48

Each solvent of Examples 1 through 16 above is added to mineral oil in a weight ratio of 50/50 at about 25° C. Each solvent is miscible in the mineral oil.

EXAMPLES 49 THROUGH 64

Metal coupons are soiled with various types of oil. The soiled metal coupons are sprayed with the solvents of Examples 1 through 16 above and allowed to air dry. Upon visual inspection, the soil appears to be substantially removed.

Known additives may be used in the present-azeotrope-like compositions in order to tailor the composition for a particular use. Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms. Other suitable inhibitors will readily occur to those skilled in the art. The inhibitors may be used alone or in mixtures thereof in any proportions. Typically, up to about 2 percent based on the total weight of the azeotrope-like composition of inhibitor might be used.

In spraying applications, the azeotrope-like compositions may be sprayed onto a surface by using a propellant. Suitable propellants include chlorofluorocarbons like dichlorodifluoromethane, hydrofluorocarbons like 1,1,1,2-tetrafluoroethane (HFC-134a), ethers like dimethyl ether and hydrocarbons like butane and isobutane.

What is claimed is:

1. Azeotrope-like compositions consisting essentially of from about 90 to about 59 weight percent 1,1,1,3,3,5,5,5-octafluoropentane, from about 10 to about 40 weight percent ethanol and from about 0 to about 1 weight percent nitromethane which boil at about 64° C. at 760 mm Hg; from about 92 to about 69 weight percent 1,1,1,3,3,5,5,5-octafluoropentane, from about 8 to about 30 weight percent isopropanol and from about 0 to about 1 weight percent nitromethane which boil at about 66° C. at 760 mm Hg; from about 99 to about 84 weight percent 1,1,1,3,3,5,5,5-octafluoropentane, from about 1 to about 15 weight percent n-propanol and from about 0 to about 1 weight percent nitromethane which boil at about 69° C. at 760 mm Hg; from about 99 to about 89 weight percent 1,1,1,3,3,5,5,5-octafluoropentane, from about 1 to about 10 weight percent n-butanol and from about 0 to about 1 weight percent nitromethane which boil at about 70° C. at 760 mm Hg; from about 90 to about 71 weight percent 1,1,1,3,3,5,5,5-octafluoropentane, from about 10 to about 28 weight percent isobutanol and from about 0 to about 1 weight percent nitromethane which boil at about 70° C. at 760 mm Hg; from about 91 to about 71 weight percent 1,1,1,3,3,5,5,5-octafluoropentane, from about 9 to about 28 weight percent t-butanol and from about 0 to about 1 weight percent nitromethane which boil at about 68° C. at 760 mm Hg; and from about 99 to about 89 weight percent 1,1,1,3,3,5,5,5-octafluoropentane, from about 1 to about 10 weight percent t-amyl alcohol and from about 0 to about 1 weight percent nitromethane which boil at about 71.0° C. at 760 mm Hg.

2. The azeotrope-like compositions of claim 1 wherein said compositions of 1,1,1,3,3,5,5,5-octafluoropentane, ethanol and optionally nitromethane boil at 64° C.±about 1° C. at 760 mm Hg.

3. The azeotrope-like compositions of claim 1 wherein said compositions consist essentially of from about 88 to about 64.5 weight percent 1,1,1,3,3,5,5,5-octafluoropentane, from about 12 to about 35 weight percent ethanol and from about 0 to about 0.5 weight percent nitromethane.

4. The azeotrope-like compositions of claim 1 wherein said compositions consist essentially of from about 86 to about 69.7 weight percent 1,1,1,3,3,5,5,5-octafluoropentane, from about 14 to about 30 weight percent ethanol and from about 0 to about 0.3 weight percent nitromethane.

5. The azeotrope-like compositions of claim 1 wherein said compositions of 1,1,1,3,3,5,5,5-octafluoropentane, isopropanol and optionally nitromethane boil at 66° C.±about 1° C. at 760 mm Hg.

6. The azeotrope-like compositions of claim 1 wherein said compositions consist essentially of from about 90 to about 72.5 weight percent 1,1,1,3,3,5,5,5-octafluoropentane, from about 10 to about 27 weight percent isopropanol and from about 0 to about 0.5 weight percent nitromethane.

7. The azeotrope-like compositions of claim 1 wherein said compositions consist essentially of from about 88 to about 74.7 weight percent 1,1,1,3,3,5,5,5-octafluoropentane, from about 12 to about 25 weight percent isopropanol and from about 0 to about 0.3 weight percent nitromethane.

8. The azeotrope-like compositions of claim 1 wherein said compositions of 1,1,1,3,3,5,5,5-octafluoropentane, n-propanol and optionally nitromethane boil at 69° C.±about 1° C. at 760 mm Hg.

9. The azeotrope-like compositions of claim 1 wherein said compositions consist essentially of from about 98 to about 89.5 weight percent 1,1,1,3,3,5,5,5-octafluoropentane, from about 2 to about 10 weight percent n-propanol and from about 0 to about 0.5 weight percent nitromethane.

10. The azeotrope-like compositions of claim 1 wherein said compositions consist essentially of from about 97 to about 91.7 weight percent 1,1,1,3,3,5,5,5-octafluoropentane, from about 3 to about 8 weight percent n-propanol and from about 0 to about 0.3 weight percent nitromethane.

11. The azeotrope-like compositions of claim 1 wherein said compositions of 1,1,1,3,3,5,5,5-octafluoropentane, n-butanol and optionally nitromethane boil at 70° C.±about 1° C. at 760 mm Hg.

12. The azeotrope-like compositions of claim 1 wherein said compositions consist essentially of from about 99 to about 91.5 weight percent 1,1,1,3,3,5,5,5-octafluoropentane, from about 1 to about 8 weight percent n-butanol and from about 0 to about 0.5 weight percent nitromethane.

13. The azeotrope-like compositions of claim 1 wherein said compositions consist essentially of from about 98 to about 92.7 weight percent 1,1,1,3,3,5,5,5-octafluoropentane, from about 2 to about 6 weight percent n-butanol and from about 0 to about 0.3 weight percent nitromethane.

14. The azeotrope-like compositions of claim 1 wherein said compositions of 1,1,1,3,3,5,5,5-octafluoropentane, isobutanol and optionally nitromethane boil at 70° C.±about 1° C. at 760 mm Hg.

15. The azeotrope-like compositions of claim 1 wherein said compositions consist essentially of from about 88 to about 74.5 weight percent 1,1,1,3,3,5,5,5-octafluoropentane, from about 12 to about 25 weight percent isobutanol and from about 0 to about 0.5 weight percent nitromethane.

16. The azeotrope-like compositions of claim 1 wherein said compositions consist essentially of from about 87 to about 78.7 weight percent 1,1,1,3,3,5,5,5-octafluoropentane, from about 13 to about 21 weight percent isobutanol and from about 0 to about 0.3 weight percent nitromethane.

17. The azeotrope-like compositions of claim 1 wherein said compositions of 1,1,1,3,3,5,5,5-octafluoropentane, t-butanol and optionally nitromethane boil at 68°±1° C. at 760 mm Hg.

18. The azeotrope-like compositions of claim 1 wherein said compositions consist essentially of from about 90 to about 74.5 weight percent 1,1,1,3,3,5,5,5-octafluoropentane, from about 10 to about 25 weight percent t-butanol and from about 0 to about 0.5 weight percent nitromethane.

19. The azeotrope-like compositions of claim 1 wherein said compositions consist essentially of from about 88 to about 77.7 weight percent 1,1,1,3,3,5,5,5-octafluoropentane, from about 12 to about 22 weight percent t-butanol and from about 0 to about 0.3 weight percent nitromethane.

20. The azeotrope-like compositions of claim 1 wherein said compositions of 1,1,1,3,3,5,5,5-octafluoropentane, t-amyl alcohol and optionally nitromethane boil at 71°±1° C. at 760 mm Hg.

21. The azeotrope-like compositions of claim 1 wherein said compositions consist essentially of from about 99 to about 91.5 weight percent 1,1,1,3,3,5,5,5-octafluoropentane, from about 1 to about 8 weight percent t-amyl alcohol and from about 0 to about 0.5 weight percent nitromethane.

22. The azeotrope-like compositions of claim 1 wherein said compositions consist essentially of from about 98 to about 93.7 weight percent 1,1,1,3,3,5,5,5-octafluoropentane, from about 2 to about 6 weight percent t-amyl alcohol and from about 0 to about 0.3 weight percent nitromethane.

23. The azeotrope-like compositions of claim 1 wherein said compositions additionally include an effective amount of an inhibitor to accomplish at least one of the following: inhibit decomposition of the compositions; react with undesirable decomposition products of the compositions; and prevent corrosion of metal surfaces.

24. The azeotrope-like compositions of claim 23 wherein said inhibitor is selected from the group consisting of 1,2-epoxyalkanes having 2 to 7 carbon atoms, phosphite esters having 12 to 30 carbon atoms, ethers having 3 or 4 carbon atoms other than said 1,2-epoxyalkanes, acetals having 4 to 7 carbon atoms, ketones having 3 to 5 carbon atoms, and amines having 6 to 8 carbons atoms.

25. A method of cleaning a solid surface comprising treating said surface with an azeotrope-like composition of claim 1.

* * * * *